US005079122A

United States Patent [19]

Bayley et al.

[11] Patent Number: 5,079,122

[45] Date of Patent: Jan. 7, 1992

[54] TONER COMPOSITIONS WITH CHARGE ENHANCING ADDITIVES

[75] Inventors: Robert D. Bayley, Fairport; Peter F. Erhardt, Webster; Edward J. Gutman, Webster; Thomas R. Hoffend, Webster; Timothy L. Lincoln; Joseph R. Weber, both of Rochester; Raymond R. Wells, Walworth, all of N.Y.

[73] Assignee: Xerox Corporation, Stamford, Conn.

[21] Appl. No.: 548,475

[22] Filed: Jul. 3, 1990

[51] Int. Cl.[5] ..... G03G 9/083; G03G 9/097

[52] U.S. Cl. ..... 430/106.6; 430/110; 430/126; 430/403

[58] Field of Search ..... 430/106.6, 110, 126, 430/903

[56] References Cited

U.S. PATENT DOCUMENTS

| | | | |
|---|---|---|---|
| 3,893,935 | 7/1975 | Jadwin et al. | 430/110 |
| 4,139,483 | 2/1979 | Williams et al. | 430/110 |
| 4,338,390 | 7/1982 | Lu | 430/106 |
| 4,487,823 | 12/1984 | Lehmann et al. | 430/133 X |
| 4,560,635 | 12/1985 | Hoffend et al. | 430/106.6 |
| 4,835,084 | 5/1989 | Nair et al. | 430/137 |
| 4,851,318 | 7/1989 | Hsieh et al. | 430/137 |
| 4,904,762 | 2/1990 | Chang et al. | 430/110 |
| 4,960,677 | 10/1990 | Seibles et al. | 430/110 X |

FOREIGN PATENT DOCUMENTS

| | | | |
|---|---|---|---|
| 8533 | 1/1979 | Japan | 430/110 |
| 59349 | 3/1986 | Japan | 430/110 |
| 166357 | 7/1987 | Japan | 430/110 |

*Primary Examiner*—Roland Martin
*Attorney, Agent, or Firm*—E. O. Palazzo

[57] ABSTRACT

A toner composition comprised of resin, pigment, and a nonionic fluorosurfactant charge enhancing additive.

36 Claims, No Drawings

TONER COMPOSITIONS WITH CHARGE ENHANCING ADDITIVES

BACKGROUND OF THE INVENTION

The invention is generally directed to toner and developer compositions, and more specifically, the present invention is directed to developer and toner compositions with certain charge enhancing additives or a mixture of charge enhancing additives, which additives impart, or assist in imparting a positive charge to the toner resin particles and enable toners with rapid admix characteristics. In one embodiment, there are provided in accordance with the present invention toner compositions comprised of resin particles, pigment particles, and a nonionic fluorosurfactant charge enhancing additive enabling, for example, rapid admix of less than about 30 seconds, stable admix characteristics, extended developer life, stable electrical properties, and compatibility with fuser rolls including Viton fuser rolls. The aforementioned toner compositions usually contain pigment particles comprised of, for example, carbon black, magnetites, cyan, magenta, yellow, blue, green, red, brown components, or mixtures thereof in an embodiment, thereby providing for the development of black or colored images. Moreover, in an embodiment the nonionic fluorosurfactant charge enhancing additives of the present invention can be added to toners containing charge enhancing additives such as distearyl dimethyl ammonium methyl sulfate wherein, for example, the admix characteristics are improved, for example the aged toner will have an admix of from about 5 to about 60 seconds as determined by a charge spectrograph; and additionally the triboelectric charging values of the aforementioned toner are a desirable 10 to about 40 microcoulombs per gram as determined by the Faraday Cage method for extended time periods. The nonionic fluorosurfactant charge enhancing additives of the present invention allow in embodiments for maintaining the charging and admixing ability of the toner over extended periods of storage and at elevated storage temperatures. Furthermore, the nonionic fluorosurfactant charge enhancing additives in an embodiment of the present invention can be applied to the surface of previously formulated toners for the primary purpose of prolonging the shelf life thereof. In this manner, the charging and admix shelf life of toners can be maintained for up to one year in an embodiment of the present invention. The toner compositions of the present invention in embodiments thereof possess excellent admix characteristics as indicated herein, and maintain their triboelectric charging capability for an extended number of imaging cycles exceeding, for example, 300,000. Also, the toner and developer compositions of the present invention can be selected for electrophotographic, especially xerographic, imaging and printing processes including color processes. Moreover, in another embodiment of the present invention the toner compositions thereof can be initially formulated and thereafter subjected to a washing step with a solution containing the nonionic fluorosurfactant additive of the present invention. Furthermore, in another embodiment the nonionic fluorosurface charge enhancing additive can be sorbed or coated on flow aid additive, such as colloidal silica, and the resulting composite can be added to the toner composition, preferably on the surface thereof, in an effective amount thereby enabling a positively charging toner with, for example, stable admix properties for extended time periods in some embodiments of the present invention.

Developer compositions with charge enhancing additives, which impart a positive charge to the toner resin, are well known. Thus, for example, there is described in U.S. Pat. No. 3,893,935 the use of quaternary ammonium salts $R_4N$ as charge control agents for electrostatic toner compositions. There is also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can imparat a positive charge to the toner composition. Further, there are disclosed in U.S. Pat. No. 4,298,672 positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635.

Compositions with inner salt charge enhancing additives are illustrated in U.S. Pat. No. 4,752,550, the disclosure of which is totally incorporated herein by reference. It is indicated in column 3, beginning at line 57, that one of the objects of the invention of the '550 patent resides in providing toner compositions containing mixtures of inner salt charge enhancing additives and other known charge enhancing additives. Examples of mixtures of charge enhancing additives are illustrated in column 4, beginning at line 1, and include mixtures of the inner salts with, for example, distearyl dimethyl ammonium methyl sulfate, reference U.S. Pat. No. 4,560,635; organic sulfate and sulfonate compositions inclusive of stearyl phenethyl dimethyl ammonium tosylates, reference U.S. Pat. No. 4,338,390; and alkyl pyridinium chlorides including cetyl pyridinium chloride, reference U.S. Pat. No. 4,298,672. Advantages of the toner and developers of the '550 patent, particularly when they include therein one additive such as the inner salts, see column 9, and note the working Examples, include rapid admix, that is the toner compositions will acquire a positive charge in a period of from about 5 seconds to about 1 minute, see column 9, beginning at line 17; compatibilty with Viton fuser rolls; lower fusing temperatures, that is from about 20° F. to about 40° F., than are achievable for toners and developers having incorporated therein some of the charge enhancing additives of the prior art, including quaternary ammonium salts.

In a patentability search report, there were mentioned as prior art U.S. Pat. No. 4,835,084, the disclosure of which is totally incorporated herein by reference, and 4,851,318. In the '084 patent there is disclosed a toner and method of preparation thereof wherein suspension stabilizer particles are removed from the surface of polymer particles by dissolving these particles in a solution containing a fluoroalkyl polyether surfactive agent, reference the Abstract of the Disclosure, and note the disclosure beginning in column 2, particularly column 2, line 50, wherein it is indicated that the stabilizers present on the surface of polymer particles are removed by the dissolution thereof wherein this dissolution is conducted in the presence of a fluoroalkyl polyether surface active agent, examples of these materials being illustrated in column 3, including Zonyl FSN available from E.I. DuPont Company. The fluorosurfactants of this patent can be selected as the charge enhancing additive of the present invention in embodiments thereof. In the '318 patent, there are described processes for encapsulated toners wherein there are selected polyethylene oxide surfactant protective colloids, which provide a toner composition that is not sensitive to humidity. According to the teachings of this patent, the surfactant can function as a stearic stabilizer to prevent coagulation, see for example column 4 and column 5 of the patent, as well as the working Examples thereof and note the types of specific surfactants that can be selected, see column 6, for example, beginning at line 45, and the disclosure in column 9.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing-additives.

There is illustrated in U.S. Pat. No. 4,404,271 a process for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Other illustrative prior art includes Japanese Publication No. 54-145542 which illustrates a negatively chargeable toner consisting of a resin, a colorant, and the charge control agent pyridoxine aliphatic acid ester; East German Patent Publication 218697 relating to liquid developers with charge control additives with structural units of Formulas (I), (II) and (III), and which contains olefinically polymerizable bonds; U.S. Pat. No. 3,850,642 relating to multilayer sensitive elements with ionizable salts, acids, esters, and surfactants as charge control agents; U.S. Pat. No. 2,970,802 illustrating a composition for the control of hypercholestermia, which composition consists of a nontoxic gelatin containing aluminum nicotinate; and U.S. Pat. No. 3,072,659 which discloses a method of preparing aluminum salts of nicotinic acid.

In U.S. Pat. No. 4,904,762 (D/89059), the disclosure of which is totally incorporated herein by reference, there are illustrated toner compositions comprised of resin, pigment, or mixtures thereof, in some instances dye, a first charge enhancing additive of a quaternary ammonium salt, and preferably distearyl dimethyl ammonium methyl sulfate, reference U.S. Pat. No. 4,560,635, the disclosure of which is totally incorporated herein by reference, and a second charge enhancing additive comprised of an alkyl ammonium bisulfate, wherein alkyl contains from 1 to about 20, and preferably from 1 to about 10 carbon atoms, such as distearyl dimethyl ammonium bisulfate, tetramethyl ammonium bisulfate, tetraethyl ammonium bisulfate, tetrabutyl ammonium bisulfate, and the like. The aforementioned charge additives can be incorporated in effective amounts into the toner or may be present on the toner surface. While not being desired to be limited to theory, it is believed that the first additive functions primarily as the charge control-component, and the second additive functions primarily as the admix charge component. The aforementioned first additive is present in various effective amounts depending on the amounts of the other components, for example. Preferably, the first additive is present in an amount of from about 0.05 to about 3 and more preferably about 0.1 to about 0.5 weight percent. Other effective amounts of first additive may be selected. Specific examples of the second charge enhancing additives selected for the aforementioned toner compositions include alkyl ammonium bisulfates, such as distearyl dimethyl ammonium bisulfate, tetramethyl ammonium bisulfate, or tetraalkyl ammonium bisulfates ($HSO_4$), reference U.S. Pat. No. 4,937,157 (D/89260), and copending application U.S. Ser. No. 396,497 (D/89261), entitled "Quaternary Ammonium Compounds and Processes Thereof", the disclosures of each of these applications being totally incorporated herein by reference, tetraethyl ammonium bisulfate, tetrabutyl ammonium bisulfate, and the like. The second additive is present in various effective amounts depending on the amounts of the other components, for example. Preferably, the second additive is present in an amount of from about 0.05 to about 2 and more preferably 0.1 to 0.3 weight percent. Other amounts of second additive can be selected, especially if the objectives of rapid admix and appropriate triboelectric characteristics are achieved. The charge additive mixtures can be present in the toner or on the surface thereof. For example, the toner compositions can be prepared by melt mixing resin, pigment, and the first and second charge additive; melt mixing the toner resin, pigment, and the first additive, followed by external blending of the second additive; or melt mixing the toner resin, pigment, and the second additive followed by external blending of the first additive.

Although toners with charge enhancing additives are known, there continues to be a need for toners which possess many of the advantages illustrated herein. Additionally, there is a need for positive charge enhancing-additives which are useful for incorporation into black or colored toner compositions. Moreover, there is a need for color toner applications with fluorosurfactant charge enhancing additives. There is also a need for toner compositions containing certain fluorosurfactant charge enhancing additives, which toners possess acceptable triboelectric charging characteristics, and excellent admixing properties. Moreover, there continues to be a need for humidity insensitive positively charged toner and developer compositions. Further, there is a need for toners with fluorosurfactant charge enhancing additives which can be easily and permanently dispersed into the toner resin particles. There also is a need for positively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally, the toner compositions of the present invention are useful in imaging apparatuses having incorporated therein layered photoresponsive imaging members, such as the members illustrated in U.S. Pat. No. 4,265,990, the disclosure of which is totally incorporated herein by reference. Furthermore, there is a need for toner compositions whose triboelectric charging characteristics and admixing properties can be adjusted independently. Also, there is a need for toner compositions which possess a triboelectric charge level of from about 10 to about 40 microcoulombs per gram, and preferably from about 10 to about 30 microcoulombs per gram, and admix charging times of from about 5 to 60 seconds, and preferably less than 15 seconds, as determined by a charge spectrograph, especially at low concentrations, for example less than 1 percent, and preferably less than 0.5 percent of the charge enhancing additives in one embodiment and which have stable admix properties for a minimum of at least six months and preferably for greater than one year at temperatures of up to about 120° F. in embodiments thereof.

Also, there is a need for toner compositions wherein the charge enhancing additive is present on the surface of the toner particles or may be present as a composite, for example, with flow aid additives such as colloidal silicas on the surface toner compositions. Another need of the present invention resides in the provision of toner compositions wherein the charge enhancing additive is a nonionic fluorosurfactant which is coated on the surface of the toner particles. Furthermore, another need resides in the formulation of toners with stable admix characteristics for extended time periods, which toner compositions are formulated and subsequently washed with a solution containing a nonionic fluorosurfactant and wherein such surfactants remain on the surface of the toner particles subsequent to washing.

SUMMARY OF THE INVENTION

It is an object of the present invention to provide toner and developer compositions with charge enhancing additives.

In another object of the present invention there are provided positively charged toner compositions useful for the development of electrostatic latent images including color images.

In yet another object of the present invention there are provided positively charged toner compositions containing nonionic fluorosurfactant charge enhancing additives, which additives can be selected in low concentrations in an embodiment as indicated herein.

Also, in another object of the present invention there are provided developer compositions with positively charged toner particles, carrier particles, and nonionic fluorosurfactant charge enhancing additives.

In yet a further object of the present invention there are provided substantially humidity insensitive positively charged toner compositions with desirable admix charging properties of less than 15 seconds to 60 seconds as determined by the charge spectrograph, and preferably less than 15 seconds for example, and acceptable stable triboelectric charging characteristics of from about 10 to about 40 microcoulombs per gram and preferably from 10 to 30 microcoulombs per gram.

Additionally, in a further object of the present invention there are provided positively charged magnetic toner compositions, and positively charged colored toners with nonionic fluorosurfactant charge enhancing additives, and wherein these compositions possess excellent shelf life stability.

In a further object of the present invention there are provided toners with improved admixing characteristics, which toners contain a fluorosurfactant available from DuPont Chemical Company as Zonyl FSN TM which is believed to have the chemical formula $F(CF_2CF_2)_{3-8}CH_2CH_2O(CH_2CH_2O)_x$ H, wherein x represents the number of repeating segments.

Another feature of the present invention resides in the provision of toners comprised of pigments or mixtures thereof, and dimethyl silicone block copolymers, available from Petrarch Systems as PS071, PS072, PS073, and the like; dimethyl silicone/ether copolymers available, for example, from Union Carbide as Silwet TM, silicone glycol copolymers available, for example, from Genesee Polymers Corporation and Mazer Chemicals as Masil TM; silicone/hydrocarbon block copolymers available, for example, as PS099 and PS099.5 available from Petrarch Systems; polyamine-polyalkoxy silane copolymers, available as PS076 for Petrarch Chemicals; polyunsaturated-polyalkoxy silane copolymers, available as PS078.5 from Petrarch Chemicals; polyacrylate-polyalkoxy silane copolymers, available as PS074.4 from Petrarch Chemicals; fluorocarbon block copolymers available from 3M Corporation as Fluorad TM fluorochemical surfactants; and the like. In an embodiment of the present invention, toners can be treated with dilute aqueous solutions of the aforementioned materials enabling, for example, a rejuvenation of the admixing characteristics of the toner, and permitting other advantages including stable acceptable admix times.

In another feature of the present invention, there are provided toners as utilized in the Xerox Corporation 5090 TM apparatus, which toners have been treated with, for example, dilute aqueous solutions of the surfactants illustrated herein, especially the ZONY FSN, and wherein the admix characteristics of the 5090 TM toner are rejuvenated, and do not degrade, or are minimized for extended time periods. Admix times of from about 15 to about 30 seconds can be obtained with the aforementioned treatment, and with aging at 115° F. for 24 hours no decrease in admix time resulted in an embodiment of the present invention.

Furthermore, in yet another object of the present invention there are provided toner compositions with nonionic fluorosurfactant charge enhancing additives, which compositions are useful in a variety of electrostatic imaging and printing processes, including color xerography.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

These and other objects of the present invention can be accomplished in embodiments of the present invention by providing toner compositions comprised of resin particles, pigment particles, and charge enhancing additives. More specifically, the present invention is directed to toner compositions comprised of resin, pigment, dye, or mixtures thereof, in some instances, and a nonionic fluorosurfactant charge enhancing additive. Also, in another embodiment of the present invention the nonionic fluorosurfactant charge additive illustrated herein can be added to toner compositions comprised of resin, pigment, dye, or mixtures thereof, and second charge enhancing additive such as a quaternary ammonium salt, and preferably distearyl dimethyl ammonium methyl sulfate, reference U.S. Pat. No. 4,560,635, the disclosure of which is totally incorporated herein by reference. The aforementioned nonionic fluorosurfactant charge additives can be incorporated in various effective amounts, such as for example from about −0.01 to about 5, and preferably from about 0.05 to about 2 weight percent into the toner or may be present on the toner surface.

In a specific embodiment of the present invention, there is provided a toner composition comprised of resin particles, pigment particles, a nonionic fluorosurfactant charge enhancing additive such as those illustrated in U.S. Pat. No. 4,835,084, the disclosure of which is totally incorporated herein by reference, and wherein the charge enhancing additive is present in the bulk of the toner or on the surface of the toner in an effective amount. Additionally, in another embodiment of the present invention the toner compositions can be initially formulated, and subsequently there can be added thereto a composite component comprised of a flow aid additive having permanently attached thereto a nonionic fluorosurfactant charge enhancing additive.

Also, in another embodiment of the present invention the toner composition is comprised of resin particles, pigment particles, and known charge enhancing additives such as distearyl dimethyl ammonium methyl sulfate and a second charge enhancing additive comprised of a nonionic fluorosurfactant, which can be incorporated into the bulk of the toner, present on the surface thereof, or present on the surface thereof as a composite, wherein the nonionic surfactant is first applied to a flow aid additive such as colloidal silica.

Examples of the nonionic fluorosurfactant charge enhancing additives include those nonionic fluorosurfactants available from, for example, E.I. DuPont Chemical Company, such as Zonyl FSN-100 and Zonyl FSO-100; nonionic fluorosurfactants available from, for example, ICI Americas Inc., such as Atsurf F-31 and Atsurf F-35; nonionic fluorosurfactants available from, for example, 3M Corporation, such as FC-170-C; and nonionic fluorosurfactants available from, for example, Atochem Inc., such as Forafac 1110. The aforementioned nonionic fluorosurfactants are believed to have a molecular structure comprised of a segment of polyalkyene oxide, such as polyethylene oxide, and a segment of polyperfluoroethylene separated by an alkylene structure so that the nonionic fluorosurfactant molecule has a chemical structure, such as $F(CF_2CF_2)_{3-20}$ $—CH_2CH_2—$ $(CH_2CH_2O)_{3-20}$, wherein the polyperfluoroethylene segment may be linear or branched. Typical properties of this type nonionic fluorosurfactants, some of which are disclosed in U.S. Pat. No. 4,835,084, are shown in the Table.

TABLE

| | |
|---|---|
| Physical Form | Paste to turbid liquid in 100 percent solids form |
| Density at 25° C. g./ml. (mg./m.$^3$) | About 1.30 to 1.36 |
| Aqueous Surface Tensions dynes/cm. (mN./m.) at 25° C. | About 15 to 25 |

TABLE-continued

| |
|---|
| 0.10 percent solids |

Examples of first charge enhancing additives selected for prepared toner compositions to which the nonionic fluorosurfactant additives of the present invention can be added include quaternary ammonium salts with distearyl dimethyl ammonium methyl sulfate being preferred. The aforementioned first additive is present in various effective amounts depending on the amounts of the other components. Preferably, the first additive is present in the prepared toner an amount of from about 0.05 to about 5 and more preferably about 0.1 to about 2 weight percent. Other effective amounts of first additive may be selected. Also, as first additives there may be selected alkyl ammonium bisulfates, such as distearyl dimethyl ammonium bisulfate, tetramethyl ammonium bisulfate, or tetraalkyl ammonium bisulfates ($HSO_4$), reference U.S. Pat. No. 4,937,157 (D/89260), the disclosure of which is totally incorporated herein by reference, and copending application U.S. Ser. No. 396,497 (D/89261), entitled "Quaternary Ammonium Compounds and Processes Thereof", the disclosure of which is totally incorporated herein by reference, tetraethyl ammonium bisulfate, tetrabutyl ammonium bisulfate, and the like in one embodiment, the nonionic fluorosurfactant additive is present in an amount of from about 0.05 to about 2 and preferably 0.1 to 0.3 weight percent. Other amounts of second fluorosurfactant additive can be selected in embodiments of the present invention especially if the objectives of rapid admix and appropriate triboelectric characteristics are achieved. In another embodiment of the present invention, there is provided a toner composition comprised of resin particles, pigment particles and a first charge enhancing additive initially formulated by known processes such as in a Banbury mill; followed by micronization and classification to enable toner particles with an average diameter of from about 10 to about 20 microns; and subsequently there is added to the toner the nonionic fluorosurfactant charge enhancing additive illustrated herein. This additive is preferably present on the surface of the toner, however, it can be included in the bulk of the toner by adding it to the Banbury mixture with the aforementioned toner components during the process formulation method. Specifically, thus the nonionic fluorosurfactant charge enhancing additive can be present in the toner on the surface thereof in an effective amount such as, for example, in an embodiment from about 0.05 to about 2 weight percent and these toner compositions can be prepared by melt mixing resin, pigment, first charge additive and nonionic fluorosurfactant charge additive; melt mixing the toner resin, pigment, and known charge additive such as distearyl dimethyl ammonium methyl sulfate; followed by external treatment of the nonionic fluorosurfactant additive onto the particulate toner surface; or melt mixing the toner resin, pigment, and the nonionic fluorosurfactant additive; followed by external blending of a known charge enhancing additive, such as distearyl dimethyl ammonium methyl sulfate.

In one specific embodiment, the toner compositions of the present invention are prepared by by mixing together and heating resin particles such as styrene butadiene copolymers, pigment particles such as magnetite, carbon black, or mixtures thereof, and an effective amount, preferably from about 0.1 percent to about 10 weight percent and preferably about 0.05 weight percent of the nonionic fluorosurfactant charge enahancing additive in a toner extrusion device and removing the formed toner composition from the device. Subsequent to cooling, the toner composition is subjected to grinding utilizing, for example, a Sturtevant micronizer for the purpose of achieving toner particle sizes, that is toner particle sizes with a volume median diameter of less than about 20 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include polyamides, styrene acrylates, styrene methacrylates, styrene butadienes, including Pliolites, other resins as illustrated in U.S. Pat. No. 4,752,550, the disclosure of which is totally incorporated herein by reference, polyolefins, epoxies, polyurethanes, vinyl resins, including homopolymers or copolymers of two or more vinyl monomers, polymeric esterification products of a dicarboxylic acid and a diol comprising a diphenol; styrene butadiene copolymers; terpolymers, such as terpolymers of styrene methylacrylate, and acryonitrile; crosslinked polymers such as styrene acrylates, or styrene methacrylates crosslinked with, for example, divinyl benzene; and mixtures thereof. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like.

As one toner resin, there are elected the esterification products of a dicarboxylic acid and a diol comprising a diphenol. Examples of these resins are illustrated in U.S. Pat. No. 3,590,000, the disclosure of which is totally incorporated herein by reference. Other toner resins include styrene/methacrylate copolymers, and styrene/butadiene copolymers; suspension polymerized styrene butadienes, reference U.S. Pat. No. 4,558,108, the disclosure of which is totally incorporated herein by reference; polyester resins obtained from the reaction of bisphenol A and propylene oxide, followed by the reaction of the resulting product with fumaric acid; and branched polyester resins resulting from the reaction of dimethyl terephthalate, 1,3-butanediol, 1,2-propanediol, pentaerythritol, and styrene acrylates; and mixtures thereof. With the latter resin, a preferred composition is that obtained from the reaction of 1.0 mole percent of dimethyl terephthalate, 0.5 mole percent of 1,3-butanediol, 0.5 mole percent of 1,2-propanediol, and 0.025 mole percent of pentaerythritol. Also, waxes with a molecular weight of from about 1,000 to about 6,000, such as polyethylene, polypropylene, and paraffin waxes can be present in the toner compositions as fuser roll release agents.

The resin particles are present in a sufficient, but effective amount, for example from about 70 to about 90 weight percent. Thus, when 2 percent by weight of the charge enhancing additive is present, and 10 percent by weight of pigment or colorant, such as carbon black, is contained therein, about 88 percent by weight of resin is selected. Also, the charge enhancing additive of the present invention may be coated on the pigment particles. When used as a coating, in an embodiment the nonionic fluorosurfactant charge enhancing additive of the present invention is present in an amount of from about 0.01 weight percent to about 5-weight percent, and preferably from about 0.05 weight percent to about 2 weight percent, and more preferably from about 0.1 to about 0.3 weight percent.

Numerous well known suitable pigments or dyes can be selected as the colorant for the toner particles including, for example, carbon black, nigrosine dye, aniline blue, magnetite, and mixtures thereof. The pigment, which is preferably carbon black, is present in a sufficient amount to render the toner composition highly colored. Generally, the pigment particles are present in amounts of from about 2 percent by weight to about 20 percent by weight, and preferably from about 5 to about 10 weight percent based on the total weight of the toner composition; however, lesser or greater amounts of pigment particles may be selected.

When the pigment particles are comprised of magnetites, thereby enabling single component toners in some instances, which magnetites are a mixture of iron oxides ($FeO.Fe_2O_3$) including those commercially available as Mapico Black, they are present in the toner composition in an amount of from about 10 percent by weight to about 70 percent by weight, and preferably in an amount of from about 10 percent by weight to about 50 percent by weight.

There can also be blended into the toner compositions of the present invention external additive particles including flow aid additives, which additives are usually present on the surface thereof. Examples of these additives include colloidal silicas, such as Aerosil, metal salts and metal salts of fatty acids, inclusive of zinc stearate; aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000; 3,655,374; 3,720,617; 3,923,503 and 3,800,588, the disclosures of which are totally incorporated herein by reference.

With further respect to the present invention, colloidal silicas, such as Aerosil, can be surface treated with the nonionic fluorosurfactant charge additive illustrated herein in an amount of from about 1 to about 30 weight percent, and preferably about 10 weight percent followed by the addition thereof to the toner in an amount of from about 0.1 to about 10 and, preferably from about 0.1 to about 1 weight percent.

Also, as indicated herein there can be included in the toner compositions of the present invention low molecular weight waxes, such as polypropylenes and polyethylenes, commercially available from Allied Chemical and Petrolite Corporation, Epolene N-15, commercially available from Eastman Chemical Products, Inc., Viscol 550-P, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent 1,442,835, the disclosure of which is totally incorporated herein by reference.

The molecular weight wax materials are present in the toner composition of the present invention in various effective amounts, however, generally these waxes are present in the toner composition in an amount of from about 1 percent by weight to about 15 percent by weight, and preferably in an amount of from about 2 percent by weight to about 10 percent by weight.

Also encompassed within the scope of the present invention in an embodiment thereof are colored toner and developer compositions comprised of toner resin particles, carrier particles, the nonionic fluorosurfactant charge enhancing additive, or other additive illustrated herein; and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts. In one embodiment, these colored pigment particles are present in the toner composition in an amount of from about 2 percent by weight to about 15 percent by weight calculated on the weight of the toner resin particles.

For the formulation of developer compositions, there are mixed with the toner composition carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron powder, steel, nickel, iron ferrites, copper zinc ferrites, other ferrites, nickel, silicon dioxide, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methyl methacrylate, and an organo silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference copending applications U.S. Ser. No. 136,791, and U.S. Ser. No. 136,792, the disclosures of which are totally incorporated herein by reference, including, for example, Kynar and polymethyl methacrylate mixtures (40/60). Generally, coating weights can vary; generally, however, from about 0.5 to about 2, and preferably from about 1 to about 3 weight percent coating weight is selected.

Furthermore, the diameter of the carrier particles is generally from about 40 microns to about 1,000 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods as indicated herein including extrusion or melt blending the toner resin particles, pigment particles or colorants, and the charge enhancing additive of the present invention, and another charge enhancing additive, if desired, followed by mechanical attrition. Other methods include those well known in the art, such as spray drying, melt dispersion, extrusion processing, dispersion polymerization, and suspension polymerization. Further, a toner containing resin particles, pigment particles or colorants and another charge enhancing agent, and in its particulate form may be surface treated with the charge enhancing additive of the present invention. Also, as indicated herein the toner composition without the charge enhancing additive can be prepared, followed by the addition of colloidal silicas surface treated with the charge additive mixture. The toners can be subjected to known micronization and classification to provide toners with an average particle diameter of, for example, from about 9 to about 25 microns.

The toner and developer compositions of the present invention may be selected for use in electrostatographic imaging apparatuses containing therein conventional photorecetors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium, selenium alloys, such as selenium arsenic (preferably 99.5/0.5), selenium tellurium (preferably 75/25), and the like; and halogen doped selenium substances, and halogen, such as chlorine doped selenium alloys, preferably with from about 5 to about 300 parts per million of halogen. Other similar photoreceptors can be selected. Specifically, the imaging members illustrated in U.S. Pat. No. 4,752,550, reference column 11, can be selected, and the imaging device may also include a Viton fuser roll. It is believed subsequent to visual observation after 100,000 imaging cycles that no, or minimal damage will occur to the Viton fuser roll with a number of the toners of the present invention, that is the Viton will not turn black, will not crack, and the surface will not harden, but rather remain smooth and soft although slightly darkened.

The formed toner compositions are usually jetted and classified subsequent to preparation to enable toner particles with a preferred average diameter of from about 5 to about 25 microns, and preferably from about 6 to about 15 microns. Also, the toner compositions of the present invention in embodiments thereof preferably possess a triboelectric charge of from about 0.1 to about 2 femtocoulombs per micron as determined by the known charge spectograph. Admix time for the toners of the present invention are preferably from about 5 seconds to 1 minute, and more specifically from about 5 to about 30 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 15 grams per minute; and further, such toner compositions can be selected for high speed electrophotographic apparatuses, that is those exceeding 70 copies per minute. Moreover, the toner compositions of the present invention are substantially insensitive in embodiments thereof to relative humidity, for example, relative humidities of from about 20 to about 80 percent, and preferably from about 50 to about 80 percent.

The following examples are being supplied to further define various species of the present invention, it being noted that these examples are intended to illustrate and not limit the scope of the present invention. Parts and percentages are by weight unless otherwise indicated.

EXAMPLE I

There was prepared a toner composition by adding to a dry blending device (the Waring Blender of Example III) with stirring 0.32 parts by weight of the charge control additive distearyl dimethyl ammonium methyl sulfate, 3.15 parts by weight of carbon black, Regal 330®, 17.0 parts by weight of Mapico Black and 79.5 parts by weight of a styrene/butadiene copolymer, 91 parts by weight of styrene and 9 parts by weight of butadiene. Subsequent to blending, the mixture was processed through a ZSK 83 twin screw extruder with water injection and a melt temperature of 440° C. The resulting pelletized product was micronized in a AFG 800 and classified to enable toner particles with a nominal volume diameter of from about 9.0 to about 9.5 microns.

Six grams of the above toner was then placed in an 8 ounce jar with 200 grams of carrier comprised of non-round Toniolo Steel containing a coating thereover comprised of 40 percent by weight of Kynar and 60 percent by weight of polymethyl methacrylate at a coating weight of 0.7 percent and wherein the coatings are fused to the carrier core in a kiln firing apparatus. The aforementioned jar was then place on a paint shaker for 10 minutes. Thereafter, a sample 0.5 gram was removed from the jar at time 0. To the jar was then added a single addition of 2 grams of the above prepared toner and the jar was shaken for 15 more seconds to obtain a 15 second sample. The sampling is repeated three more times at 15 second shaking intervals, resulting in samples with mixing times of 15, 30, 45 and 60 seconds. Subsequently, the triboelectric charging values and admix were measured for each of the samples on a known charge spectrograph, and all of the samples had a tribo of about 14 microcoulombs per grams and an admix of about 6. However, upon shelf aging for six months at room temperature the toner admix decreased to 3.0, indicating that the toner would fail to develop suitable images when selected in an imaging apparatus, such as the commercially available Xerox Corporation 5090 TM, wherein an admix of 4.5 seconds is usually preferred.

EXAMPLE II

The toner of Example I was subjected to an oven temperature of 115° F. for 24 hours, and thereafter triboelectric charging value as determined by the known Faraday Cage apparatus was 14 microcoulombs per gram, however, the admix as determined by the charge spectrograph had dropped to an unacceptable 2.5.

EXAMPLE III

In a Waring Blender equipped with a regular blending head, there were placed 600 milliliters of purified water and 0.7 gram of a 40 percent solution of Zonyl FSN. To the aforementioned water solution under a low blending speed of 1,000 RPM primarily to avoid air entrainment, was added 75 grams of the toner of Example I with the charge enhancing additive distearyl dimethyl ammonium methyl sulfate. This addition was accomplished in about 7.5 minutes. The blender was next baffled with a plastic beaker to eliminate the air vortex and mixed at a blender speed of about 3,500 RPM (setting of 45 on Variac) for 1½ minutes to thoroughly wet and treat the toner with the Zonyl FSN. The resulting slurry was then poured onto an 8.5 liter baffled reactor by means of a funnel with an extension to the bottom of the flask which contained an additional 7.6 liters of purified water. The slurry resulting was then stirred for 1 hour and 50 minutes at a speed of 100 RPM, and filtered through number 45 Whatman paper and washed with an additional 1.8 liters of water. The toner was then dried. The treated toner was then characterized for tribo and charging rate, and found as determined by a Faraday Cage or a charge spectrograph to have a triboelectric charging value of 13 microcoulombs per gram and an admix charging rate of 6. Upon heating as accomplished in Example II, and after storage for one year, the admix remained at 6.

EXAMPLE IV

There was initially prepared a composite comprised of Aerosil R972 and Zonyl FSN flouorosurfactant by adding to a blender (equipped with a polytron head) 0.5 liter of methanol, 20 grams of R972 Aerosil followed by mixing at about 1,000 RPM to wet out the Aerosil surface. To this was added 0.5 gram of a 40 percent by weight Zonyl FSN solution. The blender was then turned up to about 3,500 RPM for about 5 minutes to ensure complete wetting of the Aerosil surface. The resulting slurry was then transferred to a Roto-Vap to remove methanol. The dry powder was then removed and further dried in a vacuum oven at room temperature for about 6 hours.

Subsequently, the aforementioned composite was added to a toner composition comprised of the components of Example I with the distearyl dimethyl ammonium methyl sulfate charge enhancing additive and the resulting toner had a triboelectric charge thereon of 20 microcoulombs per gram and an admix charging rate of 5.5 as determined in a charge spectrograph. After six months of storage and heat aging, the admix charging rate decreased slightly to 5.0.

EXAMPLE V

A toner was processed as in Example I with the exception being that the charge control additive distearyl dimethyl ammonium methyl sulfate was omitted. The toner when characterized was found to have a −7 triboelectric charge and admix of a broad undesirable range exceeding 2 minutes in some instances as determined by a charge spectrograph. This toner was then washed with Zonyl FSN as in Example III and characterized. Tribo was found to be +12 with an admix time of about 30 seconds.

Other modifications of the present invention will occur to those skilled in the art subsequent to a review of the present application. These modifications, as well as equivalents thereof, are intended to be included within the scope of the present invention.

What is claimed is:

1. A toner composition comprised of resin particles, pigment particles, a first charge enhancing additive, and a second charge enhancing additive comprised of a nonionic fluorosurfactant.

2. A toner composition in accordance with claim 1 wherein the nonionic fluorosurfactant charge enhancing additive is a cotelomer comprised of a segment of polyalkylene oxide with from about 3 to about 20 alkylene oxide repeat units and a polyperfluoroethylene segment of from about 3 to about 20 perfluoromethylene repeat units, wherein both segment structures are separated and connected by a hydrocarbon.

3. A toner composition in accordance with claim 1 wherein the nonionic fluorosurfactant charge enhancing additive is present in an amount of from about 0.01 to about 5 weight percent.

4. A toner composition in accordance with claim 1 wherein the nonionic fluorosurfactant charge enhancing additive is present on the toner surface.

5. A toner composition in accordance with claim 1 with an admix time of from about 5 to about 60 seconds.

6. A toner composition in accordance with claim 1 with an admix time of from less than about 15 seconds.

7. A toner composition in accordance with claim 1 with a triboelectric charge of from about 10 to about 40 microcoulombs per gram.

8. A toner composition in accordance with claim 1 wherein the resin particles are comprised of styrene polymers, polyesters, or mixtures thereof.

9. A toner composition in accordance with claim 1 wherein the resin particles are comprised of styrene acrylates, styrene methacrylates, or styrene butadienes copolymers.

10. A toner composition in accordance with claim 1 containing a wax component with a weight average molecular weight of from about 1,000 to about 6,000.

11. A toner composition in accordance with claim 1 wherein the waxy component is selected from the group consisting of polyethylene and polypropylene.

12. A toner composition in accordance with claim 1 containing as external additives metal salts of a fatty acid, colloidal silicas, or mixtures thereof.

13. A toner composition in accordance with claim 1 wherein the pigment particles are carbon black, magnetites, or mixtures thereof; cyan, magenta, yellow, red, blue, green, brown, and mixtures thereof.

14. A toner composition in accordance with claim 1 wherein the nonionic fluorosurfactant is comprised of cotelomer with a polyethylene oxide segment and a polyperfluoroethylene segment.

15. A toner composition in accordance with claim 1 wherein the nonionic fluorosurfactant is of the formula $$F(CF_2CF_2)_{3-8}-CH_2-\overset{\overset{R}{|}}{C}H-O(CH_2\overset{\overset{R}{|}}{C}HO)_{9-13}$$

wherein R is hydrogen or alkyl.

16. A developer composition comprised of the toner composition of claim 1 and a carrier.

17. A developer composition in accordance with claim 16 wherein the carrier particles are comprised of ferrites, steel, or an iron powder.

18. A developer composition in accordance with claim 17 wherein the carrier particles are comprised of a core with a polymer coating thereover.

19. A developer composition in accordance with claim 18 wherein the coating is comprised of a methyl terpolymer, a polyvinylidine fluoride, a polymethyl methacrylate, or a mixture of polymers not in close proximity in the triboelectric series.

20. A method of imaging which comprises formulating an electrostatic latent image on a negatively charged photoreceptor, affecting development thereof with the toner composition of claim 1 and thereafter transferring the developed image to a suitable substrate.

21. A method of imaging in accordance with claim 20 wherein the transferred image is permanently fixed to the substrate.

22. A toner composition comprised of resin, pigment, a first charge enhancing additive, and a second charge enhancing additive comprised of a nonionic fluorosurfactant and, wherein the fluorosurfactant is of the formula $$F(CF_2CF_2)_{3-8}-CH_2-\overset{\overset{R}{|}}{C}H-O(CH_2\overset{\overset{R}{|}}{C}HO)_{9-13}$$

wherein R is alkyl or hydrogen.

23. A toner in accordance with claim 22 wherein the first charge additive is quaternary ammonium salts and alkyl pyridinium halides.

24. A toner in accordance with claim 22 wherein the first charge additive is distearyl dimethyl ammonium methyl sulfate.

25. A toner in accordance with claim 22 wherein the first charge additive is present in an amount of from about 0.05 to about 10 weight percent.

26. A toner in accordance with claim 22 wherein the first charge additive is present in an amount of from about 0.01 to about 3 weight percent.

27. A toner in accordance with claim 22 wherein the pigment is carbon black.

28. A toner in accordance with claim 22 wherein the pigment is magnetite.

29. A toner in accordance with claim 22 wherein the pigment is magnetite is red, blue, green, cyan, magenta, yellow, or mixtures thereof.

30. A toner in accordance with claim 22 wherein the pigment is cyan, magenta, yellow, or mixtures thereof.

31. A toner in accordance with claim 22 wherein the resin is selected from the group consisting of styrene acrylates, styrene methacrylates, or styrene butadienes.

32. A developer composition comprised of the toner of claim 22 and a carrier particles.

33. A developer in accordance with claim 22 wherein the carrier particles are comprised of a core with a polymeric coating.

34. A developer in accordance with claim 22 wherein the carrier particles are comprised of a core with polymeric coatings not in close proximity in the triboelectric series.

35. A developer in accordance with claim 22 wherein a first and second polymer are present.

36. A developer in accordance with claim 35 wherein the polymers are comprised of a mixture of polyvinylidene fluoride and polymethylacrylate.

* * * * *